United States Patent [19]

Chiu et al.

[11] 4,406,024

[45] Sep. 27, 1983

[54] FLUSHING CONTROLLER FOR TOILET

[76] Inventors: Huan-Juei Chiu; Ming-Sheng Chiu, both of 10-4 Fl., No. 62, Chang Chun Rd., Taipei, Taiwan

[21] Appl. No.: 365,833

[22] Filed: Apr. 5, 1982

[51] Int. Cl.[3] ..... F03D 1/14

[52] U.S. Cl. ..... 4/324; 4/415

[58] Field of Search ..... 4/324–326, 4/331, 345, 355, 356, 378–382, 384–386, 391–394, 405, 411–415, 249, DIG. 1

[56] References Cited

U.S. PATENT DOCUMENTS

| | | | |
|---|---|---|---|
| 1,510,865 | 10/1924 | Schossow | 4/384 |
| 2,532,977 | 12/1950 | White | 4/325 |
| 3,487,476 | 1/1970 | Stiern et al. | 4/326 |
| 3,903,551 | 9/1975 | Johnson | 4/326 |
| 3,988,786 | 11/1976 | Lehfeldt | 4/249 |
| 4,225,987 | 10/1980 | Goldman et al. | 4/324 |

*Primary Examiner*—Stephen Marcus
*Assistant Examiner*—Kenneth S. Putnam

[57] ABSTRACT

A flushing controller for toilet comprises a variable flushing actuator, a pre-set flushing actuator, a fixing bush, a float-actuated control lever and a pivotting means for control lever so that the variable flushing actuator is operated to optionally open the toilet valve for flushing urine and the pre-set flushing actuator is operated to open the toilet valve for flushing stools.

7 Claims, 7 Drawing Figures

51'
54a
O
53a
54
53b
52'
54b
5
53
14
55c
53c
55
23
42a
55b
43
55a
24
22
32
33
4
I
I
W
41
3
2
1
13
11
21

21
32
4
22
23
24
42a
13
55
55c
243
55a
43

FLUSHING CONTROLLER FOR TOILET

BACKGROUND OF THE INVENTION

U.S. Pat. No. 3,487,476 of "Water Saving Water Closet" invented by Walter W. Stiern et. al., disclosed a water closet divided into two compartments with flushing mechanism to empty one or both compartments selectively, in that two compartments, two valves and two floats were respectively provided for water-saving purpose. However, such an invention is found complex and expensive in production cost. It should be newly constructed and the traditional toilet tank can not be easily substituted with such an invention.

U.S. Pat. No. 3,903,551 of "Toilet Flushing Arrangement" by Arthur L. Johnson disclosed two discharge ports located at different levels on the discharging conduit. Hence, the cost of such a flushing arrangement will be increased and the conduit must be new purchased or installed, which can not be modified directly from conventional toilet flushing system.

The present inventor has found these defects of conventional arts and invented the present flushing controller for toilet in view of the following specification accompanying with the drawings.

SUMMARY OF THE INVENTION

The object of the present invention is to provide a flushing controller for toilet wherein a variable flushing actuator is operated to optionally open the toilet valve for flushing urine and the pre-set flushing actuator is operated to open the toilet valve for flushing stools so as to discharge suitable volume of water for saving water.

DETAILED DESCRIPTION

Figures 1, 1A:
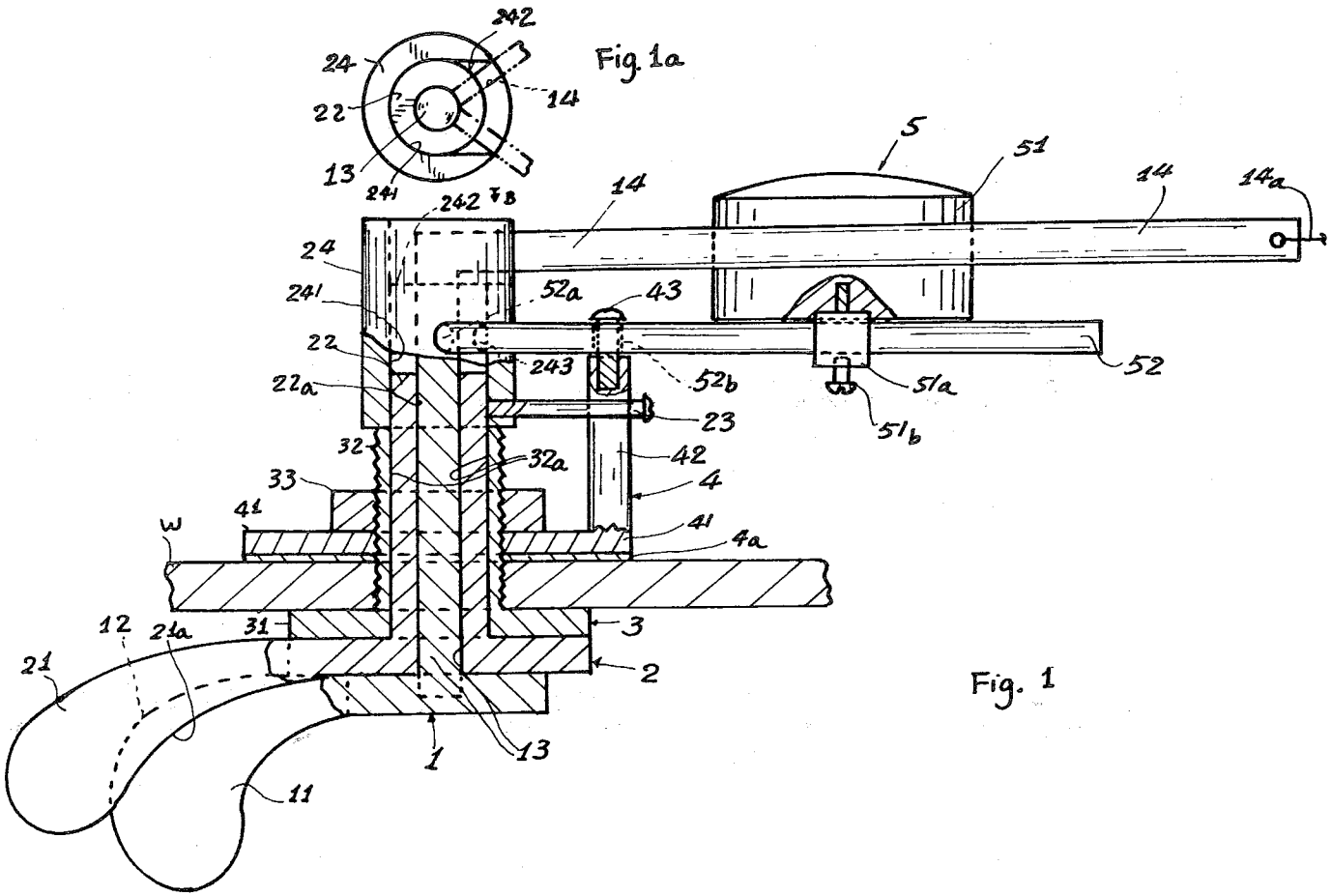
FIG. 1 is a top-view partial sectional drawing of the present invention.
FIG. 1*a* is a partial side-view illustration taken from direction B of FIG. 1.
Figure 2:
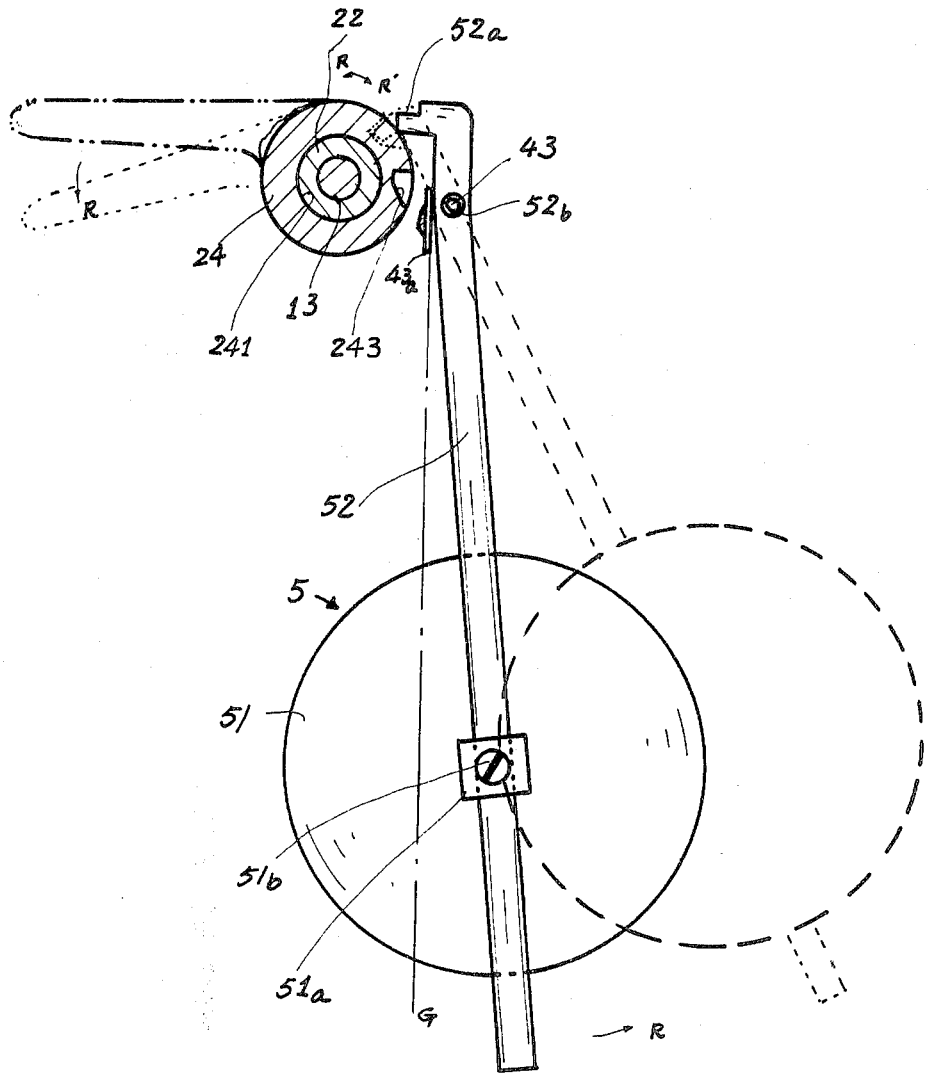
FIG. 2 is a front-view illustration showing the operation of the present invention.

As shown in FIG. 1 and FIG. 2, the present invention comprises a variable flushing actuator 1, a pre-set flushing actuator 2, a fixing bush 3, a pivotting means 4 for control lever and a float-actuated control lever 5.

Said variable flushing actuator 1 comprises a handle portion 11, an extension portion 12 extended from said handle portion, a spindle 13 and a terminated lever 14 for pulling the toilet flush valve (not shown).

Said pre-set flushing actuator 2 comprises a handle portion 21 having an extension 21*a* projectively overlapping said extension 12 of said variable flushing actuator 1, a spindle 22, an obstructing lever 23 and a cylindrical body 24 fixed onto said spindle 22. Said spindle 22 is centrally formed with a hollow hole 22*a* for freely inserting said spindle 13 of said variable flushing actuator 1. Said cylindrical body 24 is formed a central hole 241 for inserting said spindle 22. An end groove 242 is terminated on cylindrical body 24 to restrict the up-and-down action of said lever 14 as shown in FIG. 1*a*. Said obstructing lever 23 may prevent from counter rotation of said handle portion 21 so as to normally maintain said handle 21 in a horizontal position as shown in FIG. 2. Said lever 23 also serve as a fixing screw for fixing said cylindrical body 24 on said spindle 22. Said body 24 is cut with a recess 243 to engage with the hook portion 52*a* of said control lever 5.

Said fixing bush 3 comprises a fixing cap 31, a bolt 32 extending from said cap 31, and fixing nut 33, all being fixed onto the toilet wall w as packed by a rubber packing 4*a*. Said bolt 32 is centrally formed with a hollow hole 32*a* for freely inserting said spindle 22.

Said pivotting means 4 comprises a base plate 41, a pivot bar 42 and pivot 43 fixed into said bar 42. An obstruction plate 43*a* is provided to prevent from the backward motion of said control lever 5 beyond the gravity line G as FIG. 2 shown. Naturally, the lever 52*a* may be slightly bent to the right side of said line G so that the float 51 may be floated in direction R as FIG. 2 shown.

Said float-actuated control lever 5 comprises a float 51 and a control lever 52. Said float 51 comprises a collar 51*a* and an adjusting screw 51*b* so that said float 51 may be adjustably fixed on the lower portion of said lever 52. The higher the float is positioned, much water will then be saved. Said control lever 52 comprises a hook portion 52*a* on its uppermost portion and a pivot hole 52*b* for pivotedly fixing said lever 52 onto said pivot 43.

Figure 3:
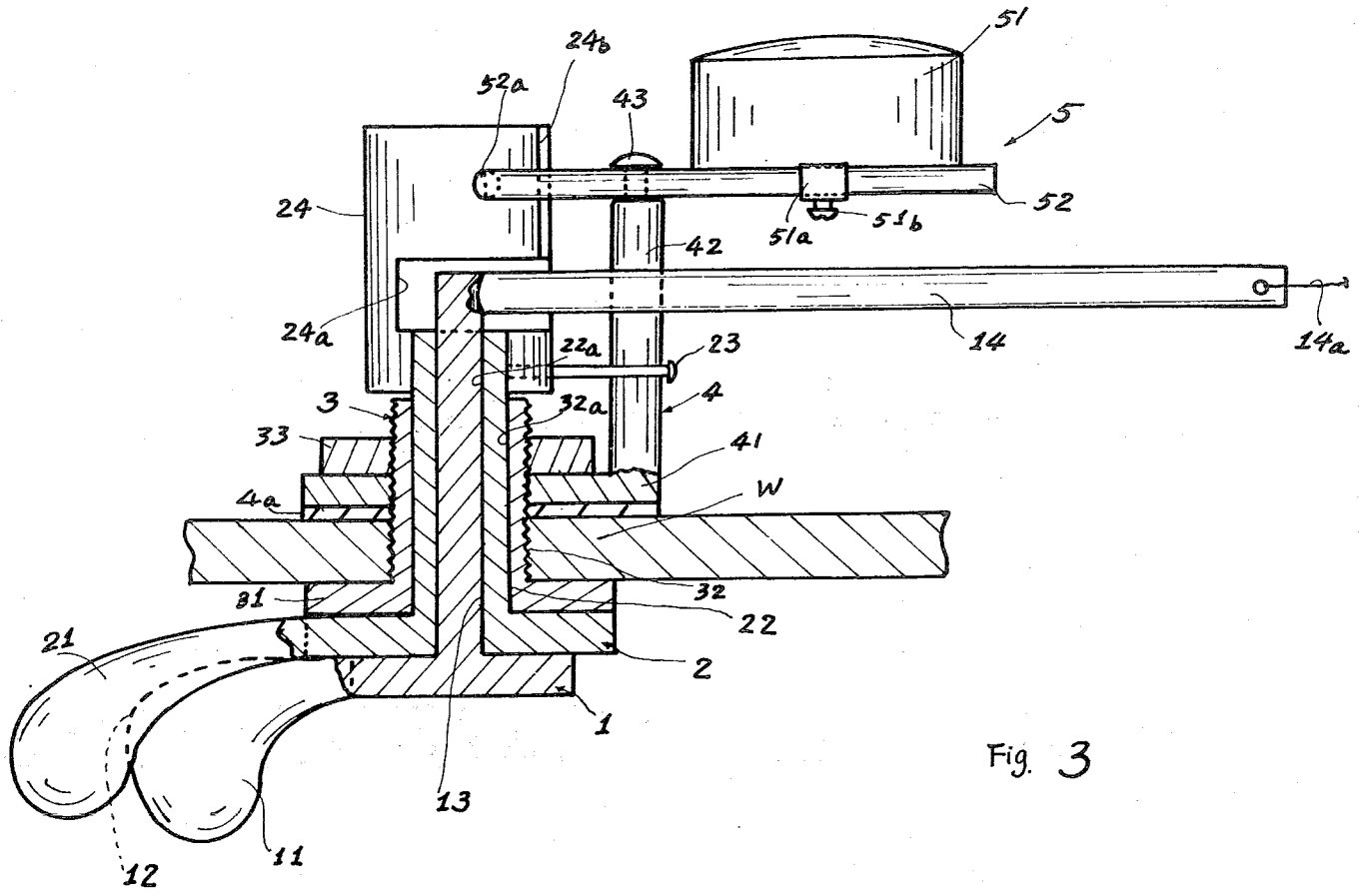
FIG. 3 is a top-view partial sectional drawing of another preferred embodiment developed from FIG. 1.

Another preferred embodiment of the present invention is shown in FIG. 3 in that a cylindrical body 24 with bigger diameter than that of said spindle 22 is fixed onto said spindle 22. An opening groove 24*a* is formed in said spindle 22 to extend said lever 14 of said spindle 13. Original recess 243 of FIG. 2 is cut as a lengthy groove 24*b* formed on the end portion of cylindrical body 24 to communicate with opening groove 24*a* as shown in FIG. 3 to engage with said hook portion 52*a* of said control lever 52. Said float 51 may be selected by dismantling the float fixed on conventional toilet valve. Said groove 24*b* also allows the insertion of said lever 14 to be fixed into the actuator 1.

When using the present invention, said handle 11 of said variable flushing actuator 1 may be depressed to allow said lever 14 pulling the toilet flush valve by a wire 14*a* connected therebetween. Once releasing the handle 11, the valve will be closed. Hence, the flushing water quantity can be optionally operated depending upon the depressing time of said actuator 1. For flushing urine, little volume of water can be flushed by depressing said handle 11 in a shorter time. If for flushing a pre-set water volume such as for flushing stools, said handle 21 of pre-set flushing actuator 2 may be depressed to depress the extension 12 of said actuator 1 to open the toilet valve for flushing water. The cylindrical body 24 will rotate in direction R so as to engage with said recess 243 or groove 24*b* with said hook portion 52*a* of said control lever 52 and said float 51 is floated as water buoyancy to force said hook portion 52*a* stably engaging into said recess 243 or groove 24*b* as FIG. 2 shown until the water level drops below said float 51 whereby the toilet valve will be automatically closed as the operation of conventional toilet valve.

Figures 4, 4A:
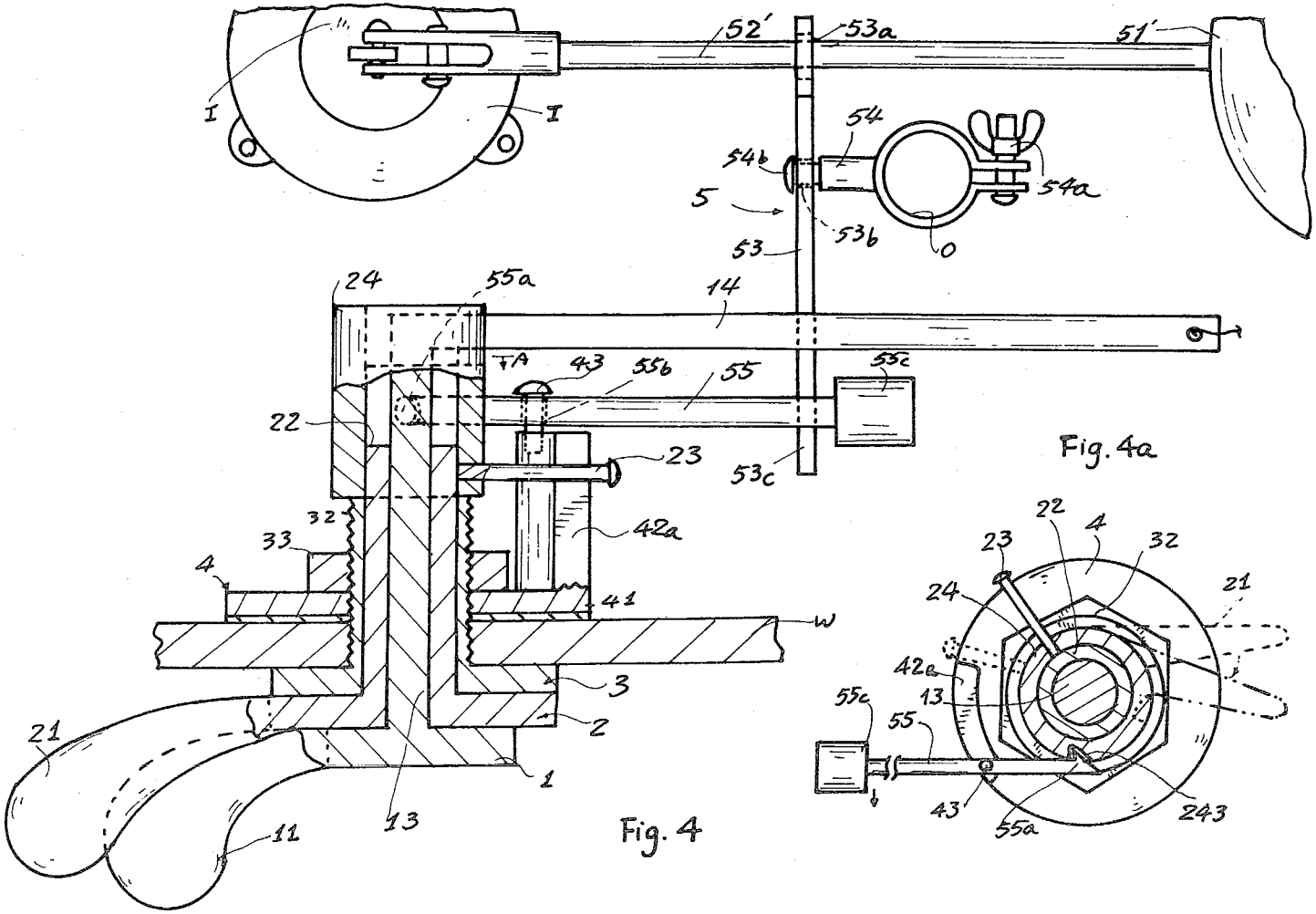
FIG. 4 is a top-view sectional drawing of still another preferred embodiment of the present invention.
FIG. 4*a* is a back-view partial illustration taken from direction A of FIG. 4.

Still another preferred embodiment of the present invention is shown in FIG. 4 which is developed from the principles of FIG. 1. The original float 51 of FIG. 1 is omitted and the float 51' of wate water supply valve I is used. The float lever 52' of valve I is passing through a hole 53*a* formed on one end of a link 53. Said link 53 is centrally formed with a pivot hole 53*b* to pivotedly connect said link 53 by means of pivot 54*b* onto a bracket 54 which is fixed on an overflow pipe 0 by a fixing screw 54*a*. Another free end 53*c* of said link 53 is positioned under a control lever 55.

Said control lever 55 is formed with a hook portion or arrow head 55*a* on its one end as shown in FIG. 4*a* to engage with a recess 243 formed on the lower perimeter of said cylindrical body 24. Said lever 55 is formed with a pivot hole 55*b* so that said lever 55 can be pivotedly fixed onto an extension wall 42*a* by a pivot 43. A counter-weight 55*c* is fixed on another end of said lever 55 so as to pressurize said hook portion or arrow head 55*a* onto said cylindrical body 24. Said extension wall 42*a* is fixed with a pivot 43 for pivotedly fixing control lever 55 thereon and also as an obstructing plate for said bar 23 to prevent from counter-rotation of said handle 21 and to normally maintain the handle 21 horizontally. The force of counter weight 55*c* is the same as the floating force of original float 51.

When depressing the handle portion 21 of said actuator 2, the recess 243 of the body 24 is engaged with said hook or arrow 55*a* of said control lever 55 and the lever 14 is raised to open the toilet valve for draining water. During flushing water from toilet valve, the float 51' will be lowered to pull the link portion 53*a* downwards and another free end 53*c* of said link 53 will be raised to lift said counter-weight. The hook or arrow 55*a* of said control lever 55 will be released from its engagement with the recess 243 so as to restore the handle 21 back to its original horizontal position and to reclose the toilet valve. The supply valve I will fill water into the toilet tank continuously.

Figure 5:
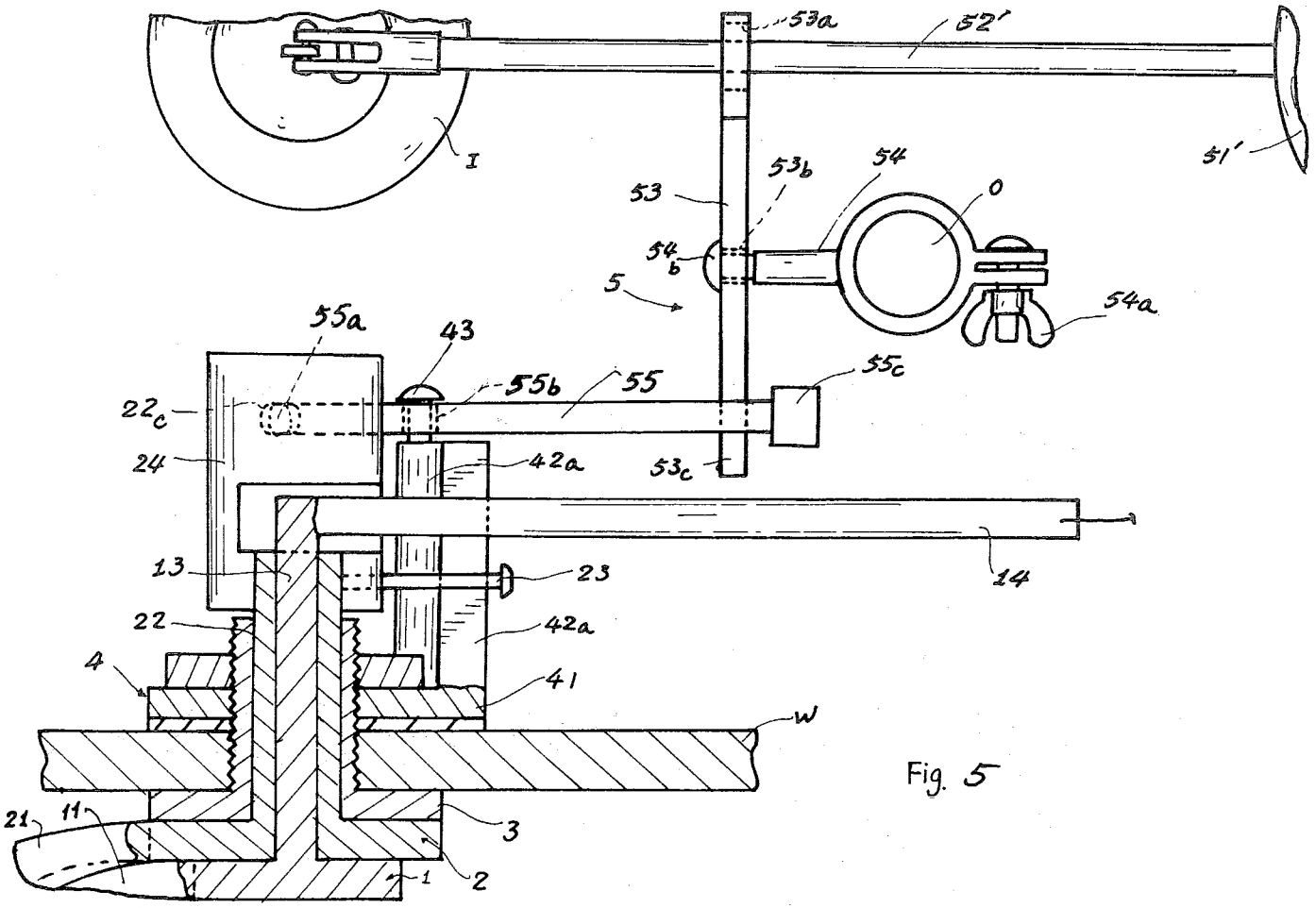
FIG. 5 is a sectional drawing of further preferred embodiment developed from FIG. 4.

FIG. 5 shows further embodiment of the present invention which is developed from the principles of FIG. 4 and FIG. 3.

The present invention has the following advantages superior to any conventional toilet flushing systems:

1. Easy assembly will not require any skill labor to construct a toilet water-saving system in accordance with the present invention. The present invention renders instant equipment for quicker service.

2. Simple construction can reduce the production cost and maintenance problems. Conventional used toilet system may be modified by the present invention by merely replacing a few parts of the present invention.

3. Either the variable flushing actuator 1 or the pre-set flushing actuator 2 can be optionally operated or adjustably operated for discharging the desired water volume for specific consumption use to save water resources.

We claim:

1. A flushing controller for toilet comprising:

a variable flushing actuator extending a spindle to connect a lever to pull the toilet flush valve;

a pre-set flushing actuator formed with a central hollow hole to freely insert said spindle of said variable flushing actuator;

a fixing bush extending a bolt which is formed with a central hollow hole to freely insert said spindle of said pre-set flushing actuator and fixing both said actuators on a wall of the toilet tank by a nut;

a pivotting means fixed on the tank wall, and a float-actuated control lever which is pivotedly fixed onto said pivotting means and is adjustably fixed with a float on its lower portion to biasedly force a hook portion, formed on its upper portion to engage with a recess on said spindle of said pre-set flushing actuator.

2. A flushing controller according to claim 1, wherein said variable flushing actuator comprises a handle portion, an extension extending inwards from said handle portion, a spindle extending from said handle portion through the toilet tank to be terminated by a lever which is connected to the toilet valve by a wire.

3. A flushing controller according to claim 1, wherein said pre-set flushing actuator comprises:

a handle portion having an extension projectively overlapping said extension portion of said variable flushing actuator;

a spindle extending inwards from the handle portion through the tank wall, being formed with a central hollow hole for the free insertion of said spindle of said variable flushing actuator;

a cylindrical body being fixed onto said spindle and formed with a recess thereon which may be engaged with the hook portion of said control lever; and an obstructing lever fixing said cylindrical body on said spindle of pre-set flushing actuator, which may prevent from counter-rotation of said handle portion so as to normally maintain said handle portion horizontally.

4. A flushing controller according to claim 1, wherein said pivotting means comprises a pivot for pivotedly fixing said control lever thereon, a pivot bar extending from a base plate and a base plate is fixed onto the tank wall by a nut of said fixing bush.

5. A flushing controller according to claim 1, wherein said float-actuated control lever comprises a float adjustably fixed on the lower portion of said lever, and a control lever which is formed with a hook portion on its uppermost portion for engaging said recess formed on said cylindrical body of pre-set flushing actuator, and formed with a pivot hole for pivotedly fixing said lever onto said pivot of pivotting means.

6. A flushing controller according to claim 1, wherein said spindle of said pre-set flushing actuator is terminated with a cylindrical body which is cut with an opening groove to extend said lever for pulling the toilet valve from said opening groove, said cylindrical body being formed with another lengthy groove on its one end to engage with said hook portion of said control lever.

7. A flushing controller for toilet comprising:

a variable flushing actuator extending a spindle to connect a lever to pull the toilet flushing valve;

a pre-set flushing actuator formed with a central hollow hole to freely insert said spindle of said variable flushing actuator and formed with a recess on the lower perimeter thereof;

a fixing bush extending a bolt which is formed with a central hollow hole to freely insert said spindle of said pre-set flushing actuator, and fixing both said actuators on a wall of the toilet tank by a nut;

an extension wall being fixed with a pivot for pivotedly fixing a control lever thereon;

a control lever pivotedly fixed on said extension wall, being formed with a hook portion on its one end to engage with said recess formed on said cylindrical body of pre-set flushing actuator and terminated with a counter weight on its another end so as to pressurize said hook portion on said cylindrical body for easy engagement of said recess with said hook portion; and a link, projectively crossing said lever, being formed with a hole on its one end for freely passing a float lever of water supply valve and formed with another free end positioned under said control lever, being centrally fixed on a bracket of overflow pipe of toilet tank.

* * * * *